US010584433B2

(12) United States Patent
Zheng et al.

(10) Patent No.: US 10,584,433 B2
(45) Date of Patent: Mar. 10, 2020

(54) SUPERCRITICAL FLUID DYEING AND FINISHING SYSTEM AND METHOD

(71) Applicant: DALIAN POLYTECHNIC UNIVERSITY, Dalian, Liaoning (CN)

(72) Inventors: Huanda Zheng, Liaoning (CN); Laijiu Zheng, Liaoning (CN); Shihui Gao, Liaoning (CN); Jun Yan, Liaoning (CN); Juan Zhang, Liaoning (CN); Xiao Wang, Liaoning (CN); Yingchong Ma, Liaoning (CN)

(73) Assignee: DALIAN POLYTECHNIC UNIVERSITY, Dalian, Liaoning (CN)

( * ) Notice: Subject to any disclaimer, the term of this patent is extended or adjusted under 35 U.S.C. 154(b) by 49 days.

(21) Appl. No.: 15/976,275

(22) Filed: May 10, 2018

(65) Prior Publication Data

US 2018/0258585 A1 Sep. 13, 2018

Related U.S. Application Data

(63) Continuation-in-part of application No. PCT/CN2017/072032, filed on Jan. 22, 2017.

(30) Foreign Application Priority Data

Nov. 21, 2016 (CN) ..... 2016 1 1039623

(51) Int. Cl.
*D06B 23/04* (2006.01)
*D06P 1/81* (2006.01)
(Continued)

(52) U.S. Cl.
CPC ..... *D06B 23/042* (2013.01); *D06B 1/02* (2013.01); *D06B 9/02* (2013.01); *D06B 19/00* (2013.01);
(Continued)

(58) Field of Classification Search
CPC .... D06P 1/81; D06P 1/94; D06B 9/02; D06B 19/00; D06B 23/04; D06B 23/042; D06B 23/14; D06B 2700/36
See application file for complete search history.

(56) References Cited

U.S. PATENT DOCUMENTS 3,914,964 A * 10/1975 Dietrich ..... B01F 13/0818 68/189
6,003,346 A * 12/1999 Hsu ..... D06B 23/10 68/150
(Continued)

FOREIGN PATENT DOCUMENTS

CN 1944762 A 4/2007
CN 101148813 A 3/2008
(Continued)

*Primary Examiner* — Joseph L. Perrin
(74) *Attorney, Agent, or Firm* — Novick, Kim & Lee, PLLC; Allen Xue

(57) ABSTRACT

A supercritical fluid dyeing and finishing system has a fabric warp beam dyeing kettle. A fabric warp beam dyeing and finishing unit is arranged in the fabric warp beam dyeing kettle. An external magnetic transmission device II is arranged outside the fabric warp beam dyeing kettle. The fabric warp beam dyeing and finishing unit includes a porous pipe I and a porous pipe II. The porous pipe I and the porous pipe II are connected with an inlet of the fabric warp beam dyeing and finishing unit through a bearing I and a bearing II. A fluid ejector is connected with the inlet of the fabric warp beam dyeing and finishing unit and disposed in the vicinity of the porous pipe I and the porous pipe II.

7 Claims, 3 Drawing Sheets

(51) Int. Cl.

| | |
|---|---|
| ***D06B 1/02*** | (2006.01) |
| ***D06B 9/02*** | (2006.01) |
| ***D06B 19/00*** | (2006.01) |
| ***D06B 23/14*** | (2006.01) |
| ***D06P 1/94*** | (2006.01) |
| *D06B 23/18* | (2006.01) |
| *D06B 23/20* | (2006.01) |

(52) U.S. Cl.
CPC ..... *D06B 23/04* (2013.01); *D06B 23/14* (2013.01); *D06P 1/81* (2013.01); *D06P 1/94* (2013.01); *D06B 23/18* (2013.01); *D06B 23/20* (2013.01); *D06B 23/205* (2013.01)

(56) References Cited

U.S. PATENT DOCUMENTS

| | | | | |
|---|---|---|---|---|
| 2016/0244902 | A1* | 8/2016 | Tsai | D06B 23/042 |
| 2018/0282944 | A1* | 10/2018 | Huang | C09B 61/00 |

FOREIGN PATENT DOCUMENTS

| | | | |
|---|---|---|---|
| CN | 201033850 | Y | 3/2008 |
| CN | 201128819 | Y | 10/2008 |
| CN | 102787459 | A | 11/2012 |
| CN | 103866515 | A | 6/2014 |
| CN | 105040317 | A | 11/2015 |
| JP | 2003082572 | A | 3/2003 |

* cited by examiner

SUPERCRITICAL FLUID DYEING AND FINISHING SYSTEM AND METHOD

TECHNICAL FIELD

The present disclosure relates to a supercritical fluid dyeing and finishing system and method, belonging to the field of dyeing and finishing.

BACKGROUND ART

With the widespread recognition of a low-carbon economic and a low-carbon development concept in various countries in the world, a large amount of wastewater discharge has become the primary challenge in the textile printing and dyeing industry. China's textile industry is facing an extremely grim prospect in the low carbon economy. According to incomplete statistics, the total amount of wastewater discharged by printing and dyeing enterprises in China reaches 3 to 4 million tons per day, COD and BOD are as high as 2000-3000 mg/L, residual dyes, heavy metals, sulfur compounds and various kinds of non-biodegradable organic additives in wastewater are difficult to be treated effectively by coagulation, filtration, adsorption and other methods, and therefore the wastewater discharged by printing and dyeing enterprises is one of industrial wastewaters which are most difficult to treat.

At the same time, statistics from China Printing and Dyeing Industry Association show that the annual water consumption of the printing and dyeing industry in China reaches 9.548 billion tons, the fresh water consumption takes the second place among various industries in the country, wherein the printing and dyeing water accounts for 80%. The total amount of printing and dyeing wastewater discharged is ranked sixth in the total emissions of various industrial sectors across the country. High dependence on water resources and high energy consumption, high emissions and other issues have seriously hampered the sustainable development of the textile printing and dyeing industry. In particular, "Carbon Tariff" implemented by developed countries have further exacerbated the impact on the textile printing and dyeing industry, which is at the low end of the textile supply chain in China. Therefore, as an important industry in the low-carbon development plan in China, the textile printing and dyeing industry must speed up its integration with the "low-carbon era." The implementation of clean production of the printing and dyeing process is the only way for the sustainable development of the industry as a whole. The development of the less-water, energy-saving and pollution-free dyeing technology has become an urgent need at home and abroad.

At present, the supercritical $CO_2$ fluid dyeing technology as a clean dyeing technology has made progress at home and abroad; wherein, the use of disperse dyes for supercritical $CO_2$ fluid dyeing of chemical fiber bulk fiber has entered the stage of industrial production, and has the advantages of small batches and multiple varieties. However, batch dyeing of fabric supercritical $CO_2$ fluid still has the problems of long dyeing time and low dyeing efficiency. In addition, supercritical $CO_2$ fluid dyeing of a rope fabric can also cause the problems of dyeing spots and fabric creases. The above problems have become the bottleneck restricting the industrialization application of batch supercritical $CO_2$ fluid dyeing and finishing of fabrics.

SUMMARY OF THE INVENTION

By the arrangement of a fabric warp beam dyeing and finishing unit, the present disclosure not only solves the problems of long time and low efficiency of batch supercritical $CO_2$ fluid dyeing of the rope fabric, but also alleviates the problems of dyeing spots and fabric creases.

The present disclosure provides a supercritical fluid dyeing and finishing system, which has a fabric warp beam dyeing kettle;

the fabric warp beam dyeing kettle includes a fabric warp beam dyeing and finishing unit and an external magnetic transmission device II, wherein the fabric warp beam dyeing and finishing unit is arranged in the fabric warp beam dyeing kettle, and the external magnetic transmission device II is arranged outside the fabric warp beam dyeing kettle;

the fabric warp beam dyeing and finishing unit includes a porous pipe I, a porous pipe II, a bearing I, a bearing II, an internal magnetic transmission device II, an internal magnetic transmission device III and a fluid ejector, wherein the porous pipe I and the porous pipe II are connected with an inlet of the fabric warp beam dyeing and finishing unit through the bearing I and the bearing II respectively, distributed in the fabric warp beam dyeing and finishing unit and provided with the internal magnetic transmission device II and the internal magnetic transmission device III respectively; the fluid ejector is connected with the inlet of the fabric warp beam dyeing and finishing unit and disposed in the vicinity of the porous pipe I and the porous pipe II.

The fabric warp beam dyeing and finishing unit of the present disclosure preferably has stoppers which are arranged on the porous pipe I and the porous pipe II respectively.

The stoppers of the present disclosure are configured to detect the change of the layer number of a fabric on the porous pipe I and the porous pipe II and control winding actions of the porous pipe I and the porous pipe II.

The fabric warp beam dyeing kettle of the present disclosure has a rotary cover shaft, a connecting rod and a hoop, wherein the rotary cover shaft is fixed on a kettle body of the fabric warp beam dyeing kettle; the connecting rod is configured to connect the rotary cover shaft with a kettle cover of the fabric warp beam dyeing kettle; the hoop is configured to connect the kettle body with the kettle cover of the fabric warp beam dyeing kettle.

The system of the present disclosure preferably comprises a dye vat;

the dye vat includes a dye drum, a dye coil pipe and a stirring device, wherein an inlet of the dye vat is sequentially connected with the dye drum, the dye coil pipe and an outlet of the dye vat, and the stirring device is arranged in the dye vat.

The dye coil pipe of the present disclosure is of a gradient porous structure whose pore diameter increases gradually from 1 μm to 1 mm from bottom to top.

The dye vat of the present disclosure is preferably connected with the fabric warp beam dyeing kettle.

Another objective of the present disclosure is to provide a supercritical fluid dyeing and finishing method using the system, which includes the following steps: putting dye and/or a finishing agent in the dye drum, and enabling supercritical carbon dioxide fluid to flow to the dye drum from the inlet of the dye vat, then flow into the dye coil pipe, pass through a hole in the dye coil pipe and flow out from the outlet of the dye vat; enabling the supercritical carbon dioxide fluid in which the dye and/or the finishing agent is dissolved to enter from the inlet of the fabric warp beam dyeing kettle, then enter into the porous pipe I and the porous pipe II on the one hand to dye and finish a fabric wound thereon, such that the porous pipe I and the porous pipe II rotate under the action of the external magnetic transmission device II, the internal magnetic transmission device II and the internal magnetic transmission device III to realize dyeing and finishing of the single-layer fabric, and enter the fluid ejector on the other hand to realize directional dyeing and finishing of the fabric.

The present disclosure has the following beneficial effects:

(1) The porous coil pipe of the present disclosure can effectively increase the contact area between dye and $CO_2$ fluid and improve the dispersibility of the dye and/or the finishing agent; meanwhile, the stirring device rotates axially in the dye vat and further improves the dispersion speed and the dissolution speed of the dye.

(2) The fabric warp beam dyeing and finishing unit of the present disclosure realizes simultaneous winding as well as dyeing and finishing of the fabric and thus improves the dyeing and finishing speed under the action of the external magnetic transmission device II, the internal magnetic transmission device II and the internal magnetic transmission device III, and also achieves directional dyeing of the fabric by the fluid ejector and further increase the dyeing and finishing speed and improve the dyeing and finishing quality.

BRIEF DESCRIPTION OF THE DRAWINGS

There are three drawings in the present disclosure, in which.

Figure 1:
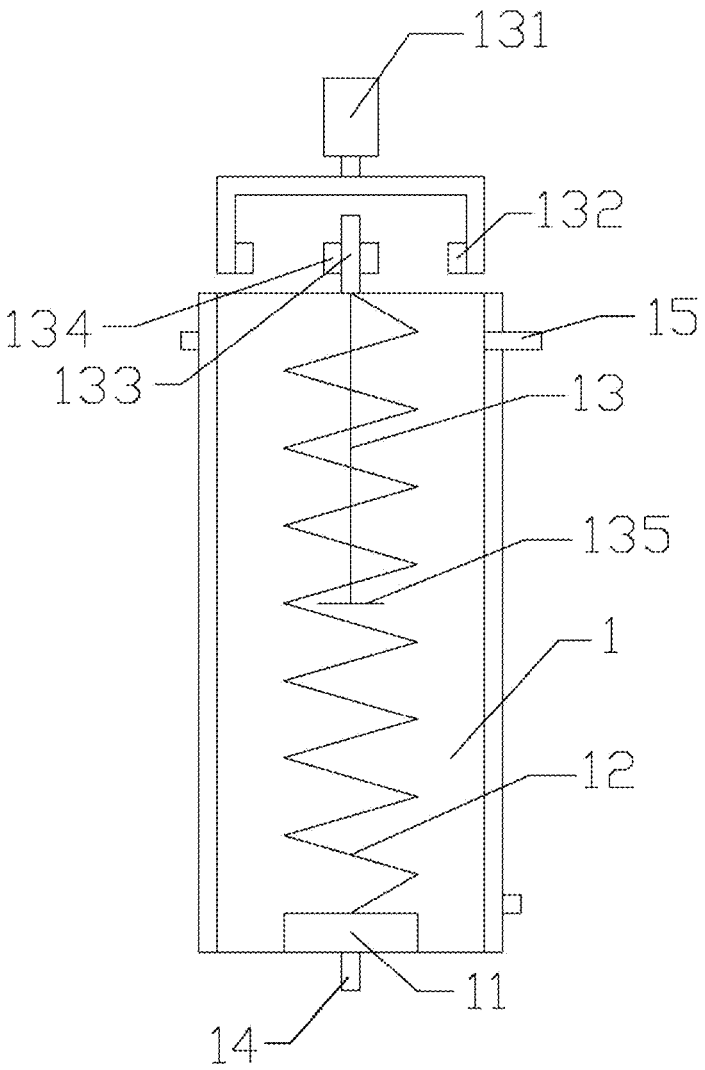
FIG. 1 is a structural schematic drawing of the dye vat of Embodiment 1.

wherein reference numerals represent the following components: 1—dye vat; 11—dye drum; 12—dye coil pipe; 13—stirring device; 14—liquid inlet; 15—liquid outlet; 131—stirring motor; 132—external magnetic transmission device I; 133—transmission rod; 134—internal magnetic transmission device I; 135—stirring blades; 2—fabric warp beam dyeing kettle; 21—fabric warp beam dyeing and finishing unit; 211—porous pipe I; 212—porous pipe II; 213—bearing I; 214—bearing II; 215—internal magnetic transmission device II; 216—internal magnetic transmission device III; 217—stopper; 218—fluid ejector; 219—cover for porous pipe II (212); 2110—cover for porous pipe I (211); 2111—cover for the fabric warp beam dyeing and finishing unit (21); 2112—hoist ring; 2113—fabric; 2114—fluid conduit; 2115—fluid conduit; 2116—fluid inlet; 22—external magnetic transmission device II; 23—rotary cover shaft; 24—connecting rod; and 25—hoop.

DETAILED DESCRIPTIONS OF THE PREFERRED EMBODIMENTS

The following non-limiting embodiments will make those ordinary skilled in the art understand the prevent invention more completely, rather than limiting the present disclosure in any way.

Embodiment 1

A supercritical fluid dyeing and finishing system includes a dye vat 1 which is connected with a fabric warp beam dyeing kettle 2.

As shown in FIG. 1, the dye vat 1 includes a dye drum 11, a dye coil pipe 12 and a stirring device 13; an inlet of the dye vat 1 is sequentially connected with the dye drum 11, the dye coil pipe 12 and an outlet of the dye vat 1; the dye coil pipe 12 is of a gradient porous structure whose pore diameter increases gradually from 1 μm to 1 mm from bottom to top; the stirring device 13 includes a stirring motor 131, an external magnetic transmission device I 132, a transmission rod 133, an internal magnetic transmission device I 134, and stirring blades 135; the stirring motor 131 is connected with the external magnetic transmission device I 132 and distributed outside the dye vat 1; the transmission rod 133 passes through the dye vat 1 and is connected with the stirring blades 135 in the stirring kettle 1; a part of the transmission rod 133 outside the dye vat 1 is provided with the internal magnetic transmission device I 134. The liquid dye enters the dye vat 1 through the inlet 14 and exits through the outlet 15.

Figure 2:
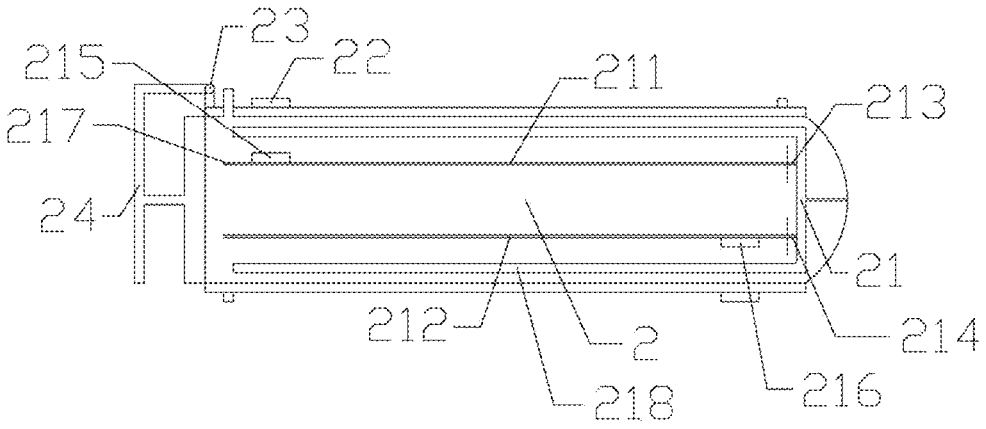
FIG. 2 is a structural schematic drawing of the fabric warp beam dyeing kettle of Embodiment 1.
Figure 3:
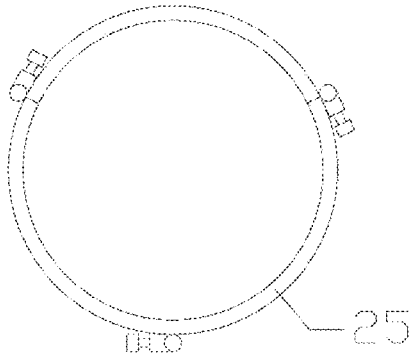
FIG. 3 is a structural schematic drawing of the hoop of Embodiment 1.
Figure 4:
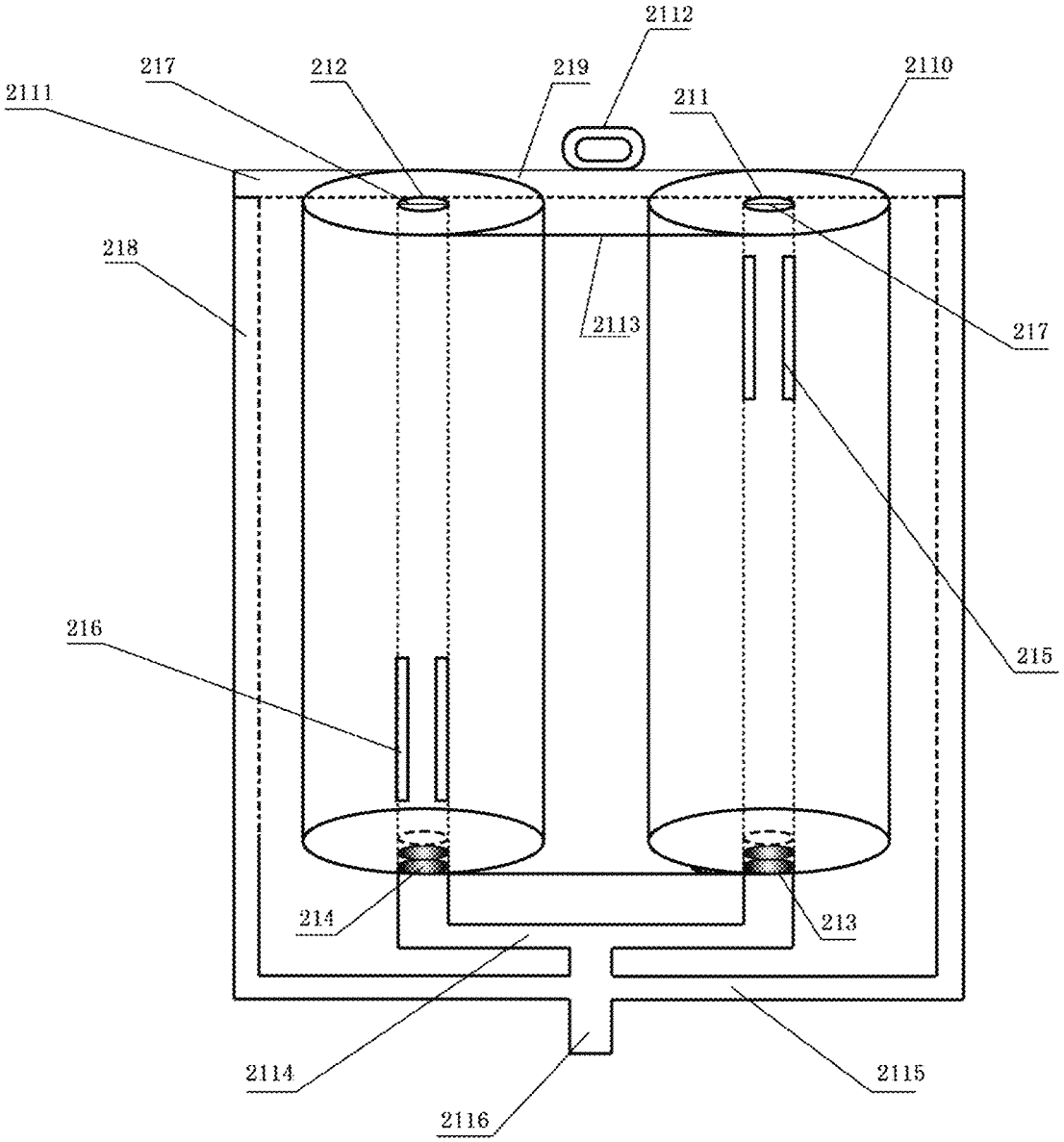
FIG. 4 shows the details of the fabric warp beam dyeing and finishing unit 21 in FIG. 3.

As shown in FIG. 2 and FIG. 4, the fabric warp beam dyeing kettle 2 includes a fabric warp beam dyeing and finishing unit 21, an external magnetic transmission device II 22, a rotary cover shaft 23, a connecting rod 24 and a hoop 25; the fabric warp beam dyeing and finishing unit 21 is arranged in the fabric warp beam dyeing kettle 2; the external magnetic transmission device II 22 is arranged outside the fabric warp beam dyeing kettle 2. The fabric warp beam dyeing and finishing unit 21 includes a porous pipe I 211, a porous pipe II 212, a bearing I 213, a bearing II 214. The porous pipe I 211 has a cover 2110 while the porous pipe II 212 has a cover 219. There is also an internal magnetic transmission device II 215, an internal magnetic transmission device II 216, stoppers 217, and a fluid ejector 218; the stoppers 217 are arranged on the porous pipe I 211 and the porous pipe II 212 respectively; the porous pipe I 211 and the porous pipe II 212 are connected with an inlet of the fabric warp beam dyeing and finishing unit 21 respectively through the bearing I 213 and the bearing II 214 and distributed in the fabric warp beam dyeing and finishing unit 21; the internal magnetic transmission device II 215, the internal magnetic transmission device II 216 are arranged on the porous pipe I 211 and the porous pipe II 212 respectively. Further, the outer wall and inner wall of unit 21 forms a casing that is connected to the inlet 2116 via fluid conduit 2115. The fluid ejector 218 in Embodiment 1 is formed by providing a plurality of holes on the inner wall of the unit 21. The ejector 218 is disposed about of the porous pipe I 211 and the porous pipe II 212 and liquid dye shoots from the ejector 218 onto the fabric 2113 wound about the porous pipes 211 and 212. The rotary cover shaft 23 is affixed on a kettle body of the fabric warp beam dyeing kettle 2; the connecting rod 24 is configured to connect the rotary cover shaft 23 with a kettle cover of the fabric warp beam dyeing kettle 2; the hoop 25 is configured to connect the kettle body with the kettle cover of the fabric warp beam dyeing kettle 2; the hoop 25 is of a trisectional structure.

Embodiment 2

A supercritical fluid dyeing and finishing method using the system of Embodiment 1 includes the following steps:

putting disperse red 60 in the dyeing drum 11 in a proportion of 1 w/w %;

winding one end of a 1000 m Dacron fabric to the porous pipe I 211 and winding the other end thereof to the porous pipe II 212;

introducing supercritical carbon dioxide fluid to the dye drum 11 from an inlet of the dye vat 1 to dissolve dye, such that the dye is sufficiently dispersed and dissolved by the dye coil pipe 12 under the impact of the supercritical carbon diode fluid and enters into the dye vat 1 through holes in the dye coil pipe 12, wherein a stirring speed of the stirring blades 135 is 50 r/min; and enabling the supercritical carbon diode fluid in which the dye is dissolved to flow out from an outlet of the dye vat 1 and enter the fabric warp beam dyeing kettle 2 to perform dyeing at a temperature of 140° C. and a pressure of 24 MPa, wherein the supercritical carbon dioxide fluid in which the dye is dissolved enters the porous pipe I 211 and the porous pipe II 212 on the one hand to perform dyeing and finishing on the Dacron fabric wound thereon, such that the porous pipe II 212 rotates for 50 min at a speed of 20 m/min under the action of the external magnetic transmission device II 22, the internal magnetic transmission device II 215 and the internal magnetic transmission device II 216 and drives the Dacron fabric on the porous pipe I 211 to be wound thereon; the supercritical carbon dioxide fluid in which the dye is dissolved on the other hand enters the fluid ejector 218 to be jetted toward the Dacron fabric; after dyeing, the pressure of the fabric warp beam dyeing kettle 2 drops to 0, the hoop 25 is separated from a kettle cover of the fabric warp beam dyeing kettle 2 under the driving of a cover-opening motor, the kettle cover of the fabric warp beam dyeing kettle 2 rotates around the rotary cover shaft 23 under the driving of a hydraulic device to realize opening, and the fabric warp shaft dyeing and finishing unit 21 removes the kettle body of the fabric warp beam dyeing kettle 2 away by using a moving wheel.

Test results show that the dyeing K/S value of the dyed Dacron fabric is 25.2, and the standard deviation of the K/S value is lower than 0.01. Meanwhile, the color fastness to washing of the dyed Dacron fabric is 5, the dry fastness to abrasion is 5, the wet fastness to abrasion is 5, and the color fastness to sunlight is 6.

Embodiment 3

A supercritical fluid dyeing and finishing method using the system of Embodiment 1 differs from Embodiment 2 in that:

disperse blue 79 is put in the dyeing drum 11 in a proportion of 0.5 w/w %;

one end of a 2000 m Dacron fabric is wound to the porous pipe I 211 and the other end thereof is wound to the porous pipe II 212;

The stirring speed of the stirring blades 135 is 100 r/min;

dyeing is performed at a temperature of 120° C. and a pressure of 26 MPa;

the porous pipe II 212 rotates for 20 min at a speed of 100 m/min;

When the stoppers 217 detect the remaining layer of the Dacron fabric, the internal magnetic transmission device II 215 stops moving and the internal magnetic transmission device II 216 begins to move, such that the Dacron fabric is rewound onto the porous pipe I 211.

Test results show that the dyeing K/S value of the dyed Dacron fabric is 16.8, and the standard deviation of the K/S value is lower than 0.02.

Embodiment 4

A supercritical fluid dyeing and finishing method using the system of Embodiment 1 differs from Embodiment 2 in that:

disperse yellow 163 is put in the dye drum 11 at a proportion of 2 w/w % one end of a 1000 m wool fabric is wound to the porous pipe I 211 and the other end thereof is wound to the porous pipe II 212;

dyeing is performed at a temperature of 100° C. and a pressure of 22 MPa.

After detection, the dyeing K/S value of the dyed Dacron fabric is 8.7, and the standard deviation of the K/S value is lower than 0.01. Meanwhile, after dyeing, the color fastness to washing of the Dacron fabric is 4, the dry fastness to abrasion is 4, the wet fastness to abrasion is 4, and the color fastness to sunlight is 6.

Embodiment 5

A supercritical fluid dyeing and finishing method using the system of Embodiment 1 differs from Embodiment 2 in that:

an anti-ultraviolet finishing agent 2-(2'-hydroxy-3',5'-di-t-phenyl)-5-chlorobenzotriazole is put in the dye drum 11 at a proportion of 0.5 w/w %;

one end of a 2000 m acrylic fabric is wound to the porous pipe I 211 and the other end thereof is wound to the porous pipe II 212;

the stirring speed of the stirring blades 135 is 200 r/min;

dyeing is performed at a temperature of 120° C. and a pressure of 23 MPa;

the porous pipe II 212 rotates for 20 min at a speed of 100 m/min;

when the stoppers 217 detect the remaining layer of the acrylic fabric, the internal magnetic transmission device II 215 stops moving and the internal magnetic transmission device II 216 begins to move, such that the acrylic fabric is rewound onto the porous pipe I 211.

Test results show that the ultraviolet shielding function of the finished acrylic fabric is more than 98%, and the finished acrylic fabric has a long-lasting anti-ultraviolet characteristic.

Embodiment 6

A supercritical fluid dyeing and finishing method using the system of Embodiment 1 differs from Embodiment 2 in that:

polyethylene glycol diethylenetriamine is put in the dye drum 11 at a proportion of 2 w/w % one end of a 500 m Dacron fabric is wound to the porous pipe I 211 and the other end thereof is wound to the porous pipe II 212;

the stirring speed of the stirring blades 135 is 150 r/min;

dyeing is performed at a temperature of 130° C. and a pressure of 25 MPa;

the porous pipe II 212 rotates for 50 min at a speed of 10 m/min.

After the detection, the surface resistivity of the finished Dacron fabric falls below $10^{10}\Omega$ and the half-life is less than 10 s.

Embodiment 7

A supercritical fluid dyeing and finishing method using the system of Embodiment 1 differs from Embodiment 2 in that:

an anti-ultraviolet finishing agent 2-(2'-hydroxy-3', 5'-di-t-phenyl)-5-chlorobenzotriazole and disperse red 153 are put in the dye drum 11 at a proportion of 0.2 w/w % and a proportion of 1 w/w % respectively;

one end of a 5000 m Dacron fabric is wound to the porous pipe I 211 and the other end thereof is wound to the porous pipe II 212;

the stirring speed of the stirring blades 135 is 300 r/min;

dyeing is performed at a temperature of 120° C. and a pressure of 26 MPa;

the porous pipe II 212 rotates for 50 min at a speed of 100 m/min.

Test results show that the dyeing K/S value of the dyed Dacron fabric is 18.2, and the standard deviation of the K/S value is lower than 0.02. Meanwhile, after dyeing, the color fastness to washing of the Dacron fabric is 5, the dry fastness to abrasion is 4 to 5, the wet fastness to abrasion is 4 to 5, and the fastness to sunlight is 6. Furthermore, the ultraviolet shielding function of the finished Dacron fabric is over 98%.

The invention claimed is:

1. A supercritical fluid dyeing and finishing system, comprising a fabric warp beam dyeing kettle;

the fabric warp beam dyeing kettle comprises a fabric warp beam dyeing and finishing unit and an external magnetic transmission device II, wherein the fabric warp beam dyeing and finishing unit is arranged in the fabric warp beam dyeing kettle, and the external magnetic transmission device II is arranged outside the fabric warp beam dyeing kettle;

the fabric warp beam dyeing and finishing unit comprises a porous pipe I, a porous pipe II, a bearing I, a bearing II, an internal magnetic transmission device II, an internal magnetic transmission device III and a fluid ejector, wherein the porous pipe I and the porous pipe II are connected with an inlet of the fabric warp beam dyeing and finishing unit through the bearing I and the bearing II respectively, distributed in the fabric warp beam dyeing and finishing unit and provided with the internal magnetic transmission device II and the internal magnetic transmission device III respectively; the fluid ejector is connected with the inlet of the fabric warp beam dyeing and finishing unit and disposed about the porous pipe I and the porous pipe II.

2. The system according to claim 1, wherein the fabric warp beam dyeing and finishing unit comprises stoppers which are arranged on the porous pipe I and the porous pipe II respectively.

3. The system according to claim 2, wherein the fabric warp beam dyeing kettle comprises a rotary cover shaft, a connecting rod and a hoop, wherein the rotary cover shaft is fixed on a kettle body of the fabric warp beam dyeing kettle; the connecting rod is configured to connect the rotary cover shaft with a kettle cover of the fabric warp beam dyeing kettle; the hoop is configured to connect the kettle body with the kettle cover.

4. The system according to claim 3, further comprising a dye vat;

the dye vat comprises a dye drum, a dye coil pipe and a stirring device, wherein an inlet of the dye vat is sequentially connected with the dye drum, the dye coil pipe and an outlet of the dye vat, and the stirring device is arranged in the dye vat.

5. The system according to claim 4, wherein the dye coil pipe is of a gradient porous structure whose pore diameter increases gradually from 1 μm to 1 mm from bottom to top.

6. The system according to claim 5, wherein the dye vat is connected with the fabric warp beam dyeing kettle.

7. A supercritical fluid dyeing and finishing method using the system according to claim 1, comprising the following steps: putting dye and/or a finishing agent in a dye drum, and enabling supercritical carbon dioxide fluid to flow to the dye drum from an inlet of a dye vat, then flow into a dye coil pipe, pass through a hole in the dye coil pipe and flow out from an outlet of the dye vat; enabling the supercritical carbon dioxide fluid in which the dye and/or the finishing agent is dissolved to enter from the inlet of the fabric warp beam dyeing kettle, then enter into the porous pipe I and the porous pipe II on the one hand to dye and finish a fabric wound thereon, such that the porous pipe I and the porous pipe II rotate under the action of the external magnetic transmission device II, the internal magnetic transmission device II and the internal magnetic transmission device III to realize dyeing and finishing of the single-layer fabric, and enter the fluid ejector on the other hand to realize directional dyeing and finishing of the fabric.

* * * * *